US012152209B2

(12) United States Patent
Bataille Morin et al.

(10) Patent No.: US 12,152,209 B2
(45) Date of Patent: Nov. 26, 2024

(54) METHANOL-BASED ENGINE FUEL CONTAINING A COMBUSTION IMPROVER ADDITIVE

(71) Applicant: VERYONE, Sorgues (FR)

(72) Inventors: Anne-Gaëlle Bataille Morin, Bures sur Yvette (FR); Richard Samson, Saran (FR); Fabrice Foucher, Saint Jean le Blanc (FR)

(73) Assignee: VERYONE, Sorgues (FR)

( * ) Notice: Subject to any disclaimer, the term of this patent is extended or adjusted under 35 U.S.C. 154(b) by 0 days.

(21) Appl. No.: 18/119,919

(22) Filed: Mar. 10, 2023

(65) Prior Publication Data

US 2023/0416626 A1 Dec. 28, 2023

(30) Foreign Application Priority Data

Jun. 23, 2022 (FR) ..... 2206260

(51) Int. Cl.

| | |
|---|---|
| ***C10L 1/23*** | (2006.01) |
| ***C10L 1/02*** | (2006.01) |
| ***C10L 10/12*** | (2006.01) |

(52) U.S. Cl.

CPC ..... *C10L 1/231* (2013.01); *C10L 1/026* (2013.01); *C10L 10/12* (2013.01); *C10L 2200/0259* (2013.01); *C10L 2200/04* (2013.01); *C10L 2270/026* (2013.01); *C10L 2290/141* (2013.01); *C10L 2290/24* (2013.01)

(58) Field of Classification Search

CPC ..... C10L 1/026; C10L 1/231; C10L 10/12; C10L 2200/0259; C10L 2200/04; C10L 2270/026; C10L 2290/141; C10L 2290/24

See application file for complete search history.

(56) References Cited

U.S. PATENT DOCUMENTS

| | | | | |
|---|---|---|---|---|
| 4,177,768 | A * | 12/1979 | Davis | C10L 10/08 44/326 |
| 4,185,594 | A | 1/1980 | Perilstein | |
| 4,248,182 | A | 2/1981 | Malec | |
| 4,801,305 | A | 1/1989 | Muller et al. | |
| 2006/0156619 | A1* | 7/2006 | Crawshaw | C10L 1/026 44/385 |
| 2017/0121621 | A1* | 5/2017 | Fabre | C10L 10/08 |

(Continued)

FOREIGN PATENT DOCUMENTS

| | | | |
|---|---|---|---|
| CN | 103865592 | A | 6/2014 |
| CN | 104232180 | A | 12/2014 |
| CN | 108587696 | A | 9/2018 |

(Continued)

OTHER PUBLICATIONS

Liu, H., Zhang, X., Zhang, Z., Wu, Y., Wang, C., Chang, W., Zheng, Z., Yao, M., "Effects of 2-ethylhexyl nitrate (EHN) on combustion and emissions on a compression ignition engine fueling high-pressure direct-injection pure methanol fuel", Fuel, 2023, 127684 (Year: 2023).*

(Continued)

*Primary Examiner* — James C Goloboy
(74) *Attorney, Agent, or Firm* — Oliff PLC

(57) ABSTRACT

A compression ignition engine fuel includes 98.0% to 99.9% by weight of methanol and 0.01% to 2.0% by weight of an alkyl nitrate or mixture of alkyl nitrates.

18 Claims, 4 Drawing Sheets

(56) References Cited

U.S. PATENT DOCUMENTS

2018/0179967 A1* 6/2018 Jennings ..... F02M 37/0064

FOREIGN PATENT DOCUMENTS

| | | | | |
|---|---|---|---|---|
| CN | 110317645 | A | 10/2019 | |
| CN | 214944586 | U | 11/2021 | |
| CN | 114561234 | A | 5/2022 | |
| DE | 27 01 588 | A1 | 7/1978 | |
| EP | 0 030 429 | A2 | 6/1981 | |
| EP | 0 116 197 | A2 | 8/1984 | |
| EP | 1674553 | A1 * | 6/2006 | ..... C10L 1/19 |

OTHER PUBLICATIONS

Dempsey, A.B., Walker, N.R., Reitz, R., "Effect of Cetane Improvers on Gasoline, Ethanol, and Methanol Reactivity and the Implications for RCCI Combustion", SAE Int. J. Fuels Lubr., 2013, 6(1), 170-187 (Year: 2013).*

Stein et al., "The Autoignitiion Behavior of Surrogate Diesel Fuel Mixtures and the Chemical Effects of 2-Ethylhexyl Nitrate (2-EHN) Cetane Improver," Society of Automotive Engineers, Inc., 1999, pp. 1029-1045.

Sep. 6, 2024 Non-Final Rejection received in U.S. Appl. No. 18/517,601.

* cited by examiner

METHANOL-BASED ENGINE FUEL CONTAINING A COMBUSTION IMPROVER ADDITIVE

FIELD OF THE INVENTION

The field of the invention is that of fuels for combustion engines. The fuel of the invention belongs to the new fuels with reduced environmental impact, for example those commonly called "e-fuels" when they are made from low-carbon electricity, low-carbon hydrogen, and/or from $CO_2$. They are considered a solution for the decarbonisation of transportation. The fuel of the invention is essentially (for at least 98%) composed of methanol and is thus part of the ecological alternatives for the replacement of fossil fuels. The invention relates to an additive which, when incorporated into methanol, ensures better ignition and faster combustion of the fuel in the engine.

STATE OF THE ART

Methanol of the "e-fuels" type represents a credible low environmental impact alternative to replace fossil fuels and biofuels for combustion engines in the near future. The combustion of methanol thus produced leads to a neutral $CO_2$ balance. Methanol as a fuel has a usable energy density in combustion engines but has a low cetane number. Its ignition in compression ignition engines, such as diesel, is problematic especially at low engine speeds. Different ways to improve the ignition of methanol in a compression ignition engine have been described.

The first means is the co-injection of a pilot fuel or additive with methanol into the engine. For example, patent application CN 214944586 describes the co-injection of a diesel-type pilot fuel with methanol as the primary fuel. The scientific article "Effect of Cetane Improvers on Gasoline, Ethanol, and Methanol Reactivity and the Implications for RCCI Combustion" (SAE International Journal of Fuels and Lubricants Vol. 6, No. 1 (April 2013), pp. 170-187) describes the co-injection of 2-ethylhexyl nitrate (EHN) with a fuel consisting primarily of methanol. During combustion in a specific RCCI (Reactivity Compression Controlled Ignition) mode, a well-mixed fuel and low-reactivity oxidizer (usually with air) are compressed but do not reach self-ignition. Later, still during the compression cycle, high reactivity fuel, in this case EHN, is injected to form a local mixture of low and high reactivity fuel. The mass ratios of co-injected EHN are about 6%. This type of process has the major disadvantage of requiring co-injection control according to the engine's operating conditions, structural arrangements such as separate tanks and injection systems. Also, the use of a fuel oil as a pilot fuel generates $CO_2$ emissions with a negative impact on the environment.

The second means is a mixture of fuels with methanol. It is known that alcohols, such as methanol or ethanol, can be mixed in a minority or majority proportion with fossil or synthetic diesel fuels such as dimethyl ether (DME) or with gasoline. In this case again the $CO_2$ emission balance is negative for the environment.

The third means is the incorporation of an ignition improvement additive in admixture with methanol, possibly also in admixture with diesel fuel. Numerous patent applications, such as CN 103865592 and CN 104232180, describe the incorporation of a cocktail of multifunctional additives in a mixture with methanol, possibly also in a mixture with a fuel oil. These additives have, for example, conservation, anti-corrosion, combustion improvement and detergency functions. These additives generally represent at least 10% of the weight of the fuel. The proportion of methanol in the fuel is between 30% and 90% by weight depending on the weight percentages of additives and diesel fuel present in the fuel.

The combined effects of these additives are only observed in a global way without dosing with precision the necessary quantities. It is therefore not a fuel essentially composed of methanol.

On another level, in the field of hydrocarbon diesel or bio-diesel fuels, 2-ethylhexyl nitrate (EHN) has long been known to be used as a cetane enhancer in diesel fuel. A higher cetane value ensures lower fuel consumption, reduced particulate matter and NOx emissions, faster cold engine start, reduced engine knock and noise, and reduced engine wear. The reaction mechanism of EHN in the presence of a hydrocarbon diesel fuel has been studied for example in the scientific publication "The Autoignition Behavior of Surrogate Diesel Fuel Mixtures and the Chemical Effects of 2-Ethylhexyl Nitrate (2-EHN) Cetane Improver" (vol. 108, section 4: Journal of fuels and lubricants (1999), pp. 1029-1045). However, the reaction mechanism of its diesel fuel cetane improver effect is still poorly understood and its use is based on empirical laws. For this reason, its effectiveness on fuels other than diesel cannot be presumed. This additive is industrially produced and widely used in commercial diesel fuels. More than fifty thousand tons of EHN have been produced per year in Europe since the 1980s. Other alkyl nitrates can also be used as cetane enhancement additives in diesel fuel. FIG. 1 shows the similarity to EHN of the cetane number effects of different alkyl nitrates in addition to a standard diesel fuel (medium paraffinic (~40%) with a low natural cetane number but a standard cetane enhancement response). The cetane enhancement effect is obtained for an alkyl nitrate incorporation in the diesel fuel close to 0.03% by weight.

The present invention provides a solution for improving the ignition of methanol in combustion engines. This improvement is obtained by adding the EHN additive alone in a very small proportion by weight in a mixture with the methanol fuel. More broadly, other alkyl nitrates, known to have cetane number improving properties similar to EHN for diesel fuel, are also advocated in the context of the present invention for improving the ignition of methanol. It is unexpected that additives known to increase the cetane number of a diesel or biodiesel hydrocarbon can be so effectively used, at very low weight percentages, to improve the ignition of an alcohol such as methanol.

SUMMARY OF THE INVENTION

The invention relates to a fuel comprising from 98.0% to 99.9% by weight of methanol for compression autoignition or spark ignition engines, and from 0.01% to 2.0% by weight of a compound for improving the ignition delay of methanol.

Said compound is an alkyl nitrate or a mixture of alkyl nitrates.

Said compound has the advantage of being liquid at room temperature, low flammability, non-toxic and industrially produced.

The said compound, at these low levels in the presence of the fuel methanol, is therefore conventionally assimilated to a fuel additive.

The addition of said liquid compound is carried out in a mixture with methanol in liquid state to form the fuel according to the invention in a tank. It can also be stored separately and mixed with the methanol to form the fuel according to the invention prior to its injection into the engine, or co-injected to form the fuel according to the invention in a premix chamber of the engine.

The said compound, of the alkyl nitrate type, previously reserved for improving the cetane number of fossil diesel or biodiesel hydrocarbon fuels, is thus used effectively and surprisingly as additive for improving the ignition of methanol.

DESCRIPTION OF THE INVENTION

Figure 1:
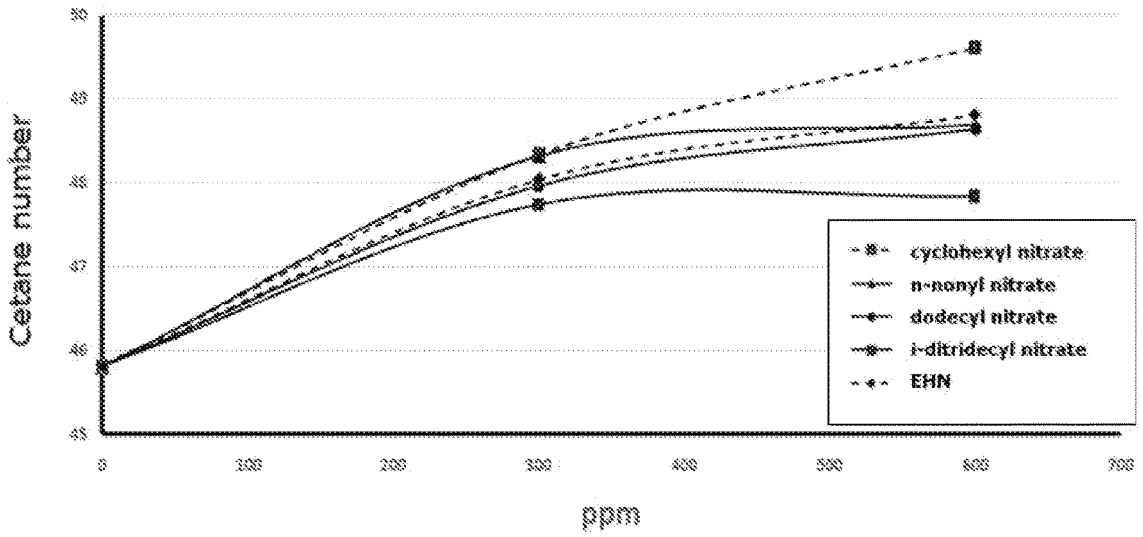
FIG. 1 shows the effect of alkyl nitrates on the cetane number of a standard diesel fuel.

The present disclosure relates to a compression ignition or spark ignition engine fuel which comprises about 98.0% to about 99.9% by weight of methanol and about 0.01% to about 2.0% by weight of a compound consisting of an alkyl nitrate or a mixture of alkyl nitrates.

In one embodiment, the fuel comprises about 0.05% to about 1.5% by weight of said compound. In another embodiment, the fuel comprises about 0.1% to about 1.0% by weight of said compound. In another embodiment, the fuel comprises about 0.1% to less than 1.0% (<0.1%) by weight of said compound.

In one embodiment, the fuel of the invention consists of methanol and said compound (and in this case, the amount of compound in the fuel is at least 0.1% by mass).

In another embodiment, when the sum of the amount of methanol and the amount of compound is not equal to 100% by weight, the fuel may contain one or more other additives to make the fuel 100% complete, such as additives with preservative, anti-corrosion or detergent functions.

Said compound added to the methanol is selected from one or more linear, branched or cyclic alkyl nitrates.

Said compound is more particularly selected from linear alkyl nitrates having 4 to 36, advantageously 4 to 24 carbon atoms, branched alkyl nitrates having 4 to 36, advantageously 4 to 24 carbon atoms, cyclic alkyl nitrates (or cycloalkyl nitrate) having 5 to 18 carbon atoms, and mixtures thereof. In one embodiment, said compound is selected from 2-ethylhexyl nitrate, cyclohexyl nitrate, dodecyl nitrate, n-nonyl nitrate, 2-tetradecyl-1-octadecyl nitrate, hexyl nitrate, 2-octyl nitrate, isononyl nitrate, 2-propylheptyl nitrate, a mixture of $C_9$ to $C_{13}$ branched alkyl nitrates, and mixtures thereof. In one embodiment, the alkyl nitrate is 2-ethylhexyl nitrate alone or in admixture with one or more other alkyl nitrates as defined above, advantageously the alkyl nitrate is 2-ethylhexyl nitrate.

Mixtures of $C_9$ to $C_{13}$ branched alkyl nitrates can be synthesized from the corresponding mixtures of branched $C_9$ to $C_{13}$ alcohols, for example the alcohols available under the tradename Exxal™ from Exxon. As an example, a mixture of at least two branched alcohols selected from a $C_9$ branched alcohol, a $C_{10}$ branched alcohol, a $C_{11}$ branched alcohol, a $C_{12}$ branched alcohol and a $C_{13}$ branched alcohol can be prepared and then the corresponding mixture of alkyl nitrates can be synthesized.

According to an embodiment, the methanol ignition enhancement compound, consisting of an alkyl nitrate or a mixture of alkyl nitrates, is mixed with the methanol in the tank supplying the engine, to obtain the fuel according to the invention.

According to one embodiment, said compound and methanol are stored separately, and brought together in an injector, thereby forming the fuel according to the invention before it is fed into the combustion chamber of the engine.

According to one embodiment, said compound is stored separately from the methanol and is co-injected with the methanol to form the fuel according to the invention in a premix chamber of the engine.

The present disclosure also relates to the use of an alkyl nitrate or mixture of alkyl nitrates (as defined above), in the proportions defined above, as an ignition improver for a fuel based on (or consisting of) methanol.

The present disclosure also relates to a method for improving the ignition of a fuel based on (or consisting of) methanol in a combustion engine, the method comprising adding to the methanol an alkyl nitrate or a mixture of alkyl nitrates (as defined above), in the proportions defined above. In one embodiment, the alkyl nitrate or mixture of alkyl nitrates and methanol are mixed in an injector. In one embodiment, the alkyl nitrate or mixture of alkyl nitrates and methanol are mixed in a premix chamber of the engine.

The present disclosure also relates to an engine of a motorized vehicle (such as a car, truck, tractor, etc.), or motorized vessel (such as a tanker, container ship, etc.) containing a fuel as defined above. The present disclosure also relates to a motorized vehicle or vessel comprising a combustion engine comprising a fuel as defined above.

The present disclosure is illustrated by the following examples given for information purposes.

EXAMPLES

The ignition delay improvement of methanol was measured under test conditions equivalent to those described in the scientific paper "Ignition delay times of $NH_3$/DME blends at high pressure and low DME fraction: RCM experiments and simulations" (Combustion and Flame Volume 227, May 2021, Pages 120-134). The test laboratory engine is a fast compression machine equivalent to the one described in this scientific paper. This is a fast compression machine for measuring the auto-ignition time of a mixture. This machine allows compressing in a very short time the mixture in order to obtain preset pressure and temperature conditions. The liquids are admitted into the tank through a different orifice than the gas inlet. The liquid quantities are measured with a syringe and a precision balance.

The ignition delay dAI is defined according to the following formula in which Pc is the pressure applied to the injected fuel:

$$dAI = t\left(\frac{dP}{dt}_{max}\right) - t(P_c)$$

Example 1

Figure 2:
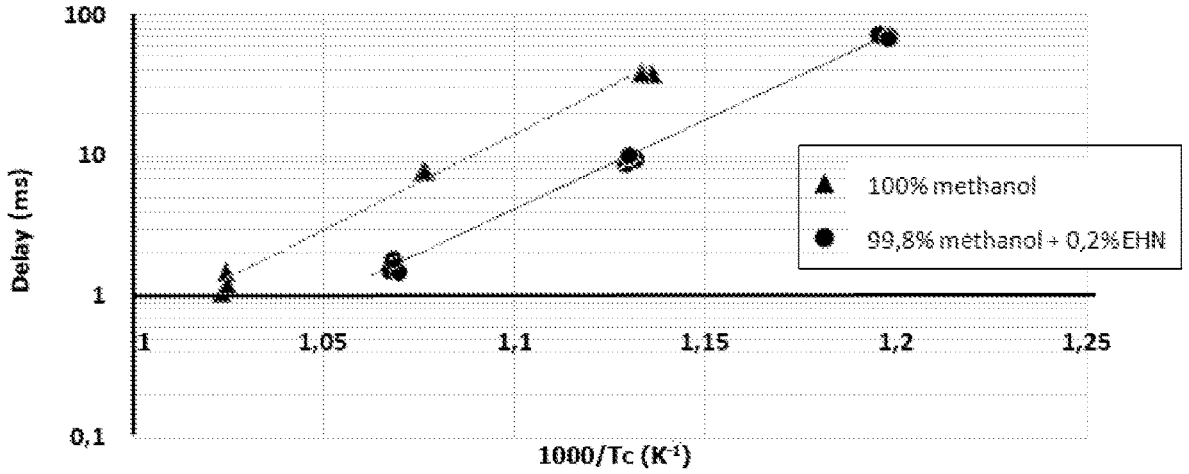
FIG. 2 shows the effect of EHN on the ignition delay of methanol for a richness (air/fuel) of 0.5 at a compression pressure Pc of 30 bars: left curve=fuel consisting of 100% methanol, right curve=fuel consisting of 99.8% methanol and 0.2% EHN.
Figure 3:
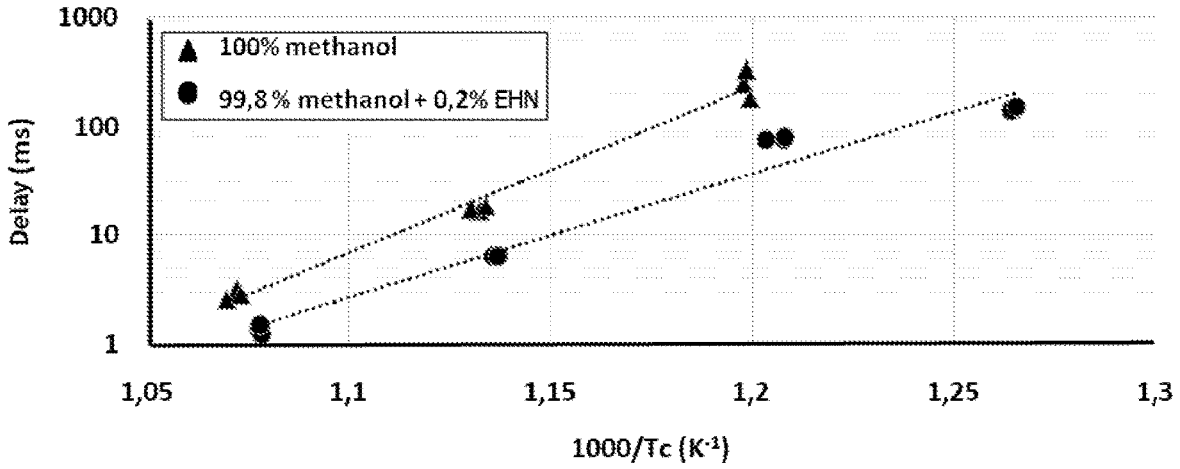
FIG. 3 shows the effect of EHN on the ignition delay of methanol for a richness (air/fuel) of 1 at a compression pressure Pc of 30 bars: left curve=fuel made of 100% methanol; right curve=fuel made of 99.8% methanol and 0.2% EHN.
Figure 4:
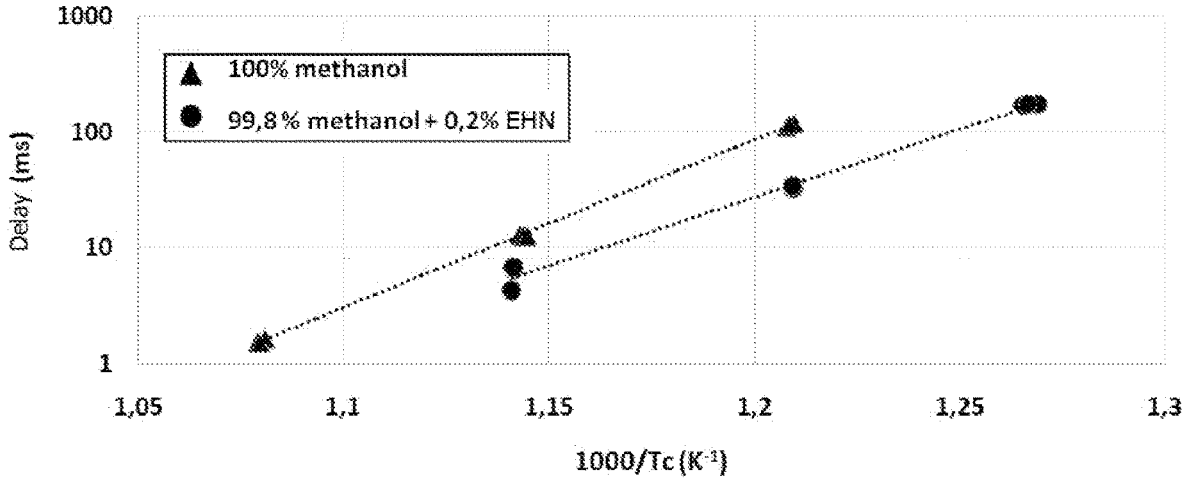
FIG. 4 shows the effect of EHN on the ignition delay of methanol for a richness (air/fuel) of 1.5 at a compression pressure Pc of 30 bars: left curve=fuel made of 100% methanol; right curve=fuel made of 99.8% methanol and 0.2% EHN.

The ignition delays were determined as a function of the injection temperature (between 800K and 1000K), at a pressure Pc of 30 bar, of a fuel according to the invention consisting of 99.8% by mass of methanol and 0.2% by mass of EHN and for a richness of 0.5, 1 and 1.5 of mixture with air respectively. The results are shown in FIGS. 2, 3 and 4 with the ignition delay benchmarks of methanol alone. There is a significant reduction, approximately by a factor of 5 to 10, in fuel ignition delay when the fuel contains EHN, compared to methanol alone. This reduction in ignition delay compared to methanol alone is all the more important that the temperature is low.

Example 2

Figure 5:
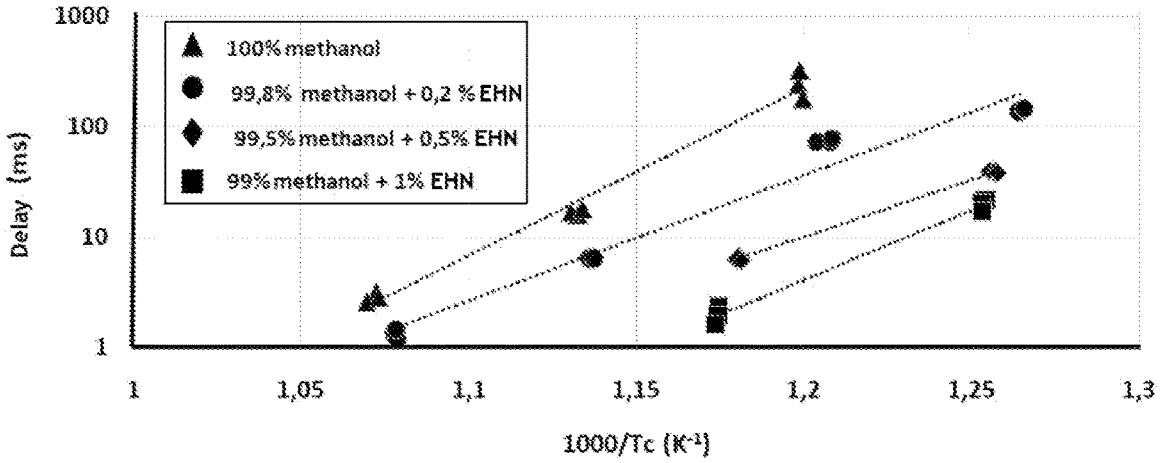
FIG. 5 shows the ignition delay of a methanol-based fuel containing different amounts of EHN as a function of temperature, for a richness (air/fuel) of 1 at a compression pressure Pc of 30 bars: curves from left to right=fuel consisting of 100% methanol; fuel consisting of 99.8% methanol and 0.2% EHN; fuel consisting of 99.5% methanol and 0.5% EHN; fuel consisting of 99.0% methanol and 1.0% EHN.
Figure 6:
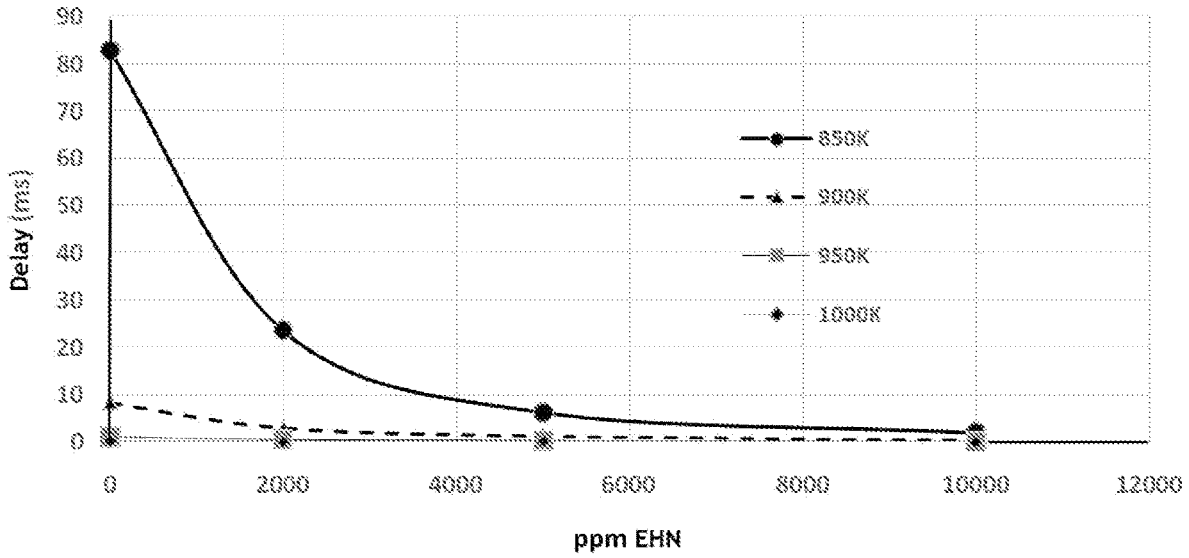
FIG. 6 shows the ignition delay of a methanol-based fuel containing different amounts of EHN, for a richness (air/fuel) of 1, at a compression pressure Pc of 30 bar, over a temperature range from 850K to 1000K.
Figure 7:
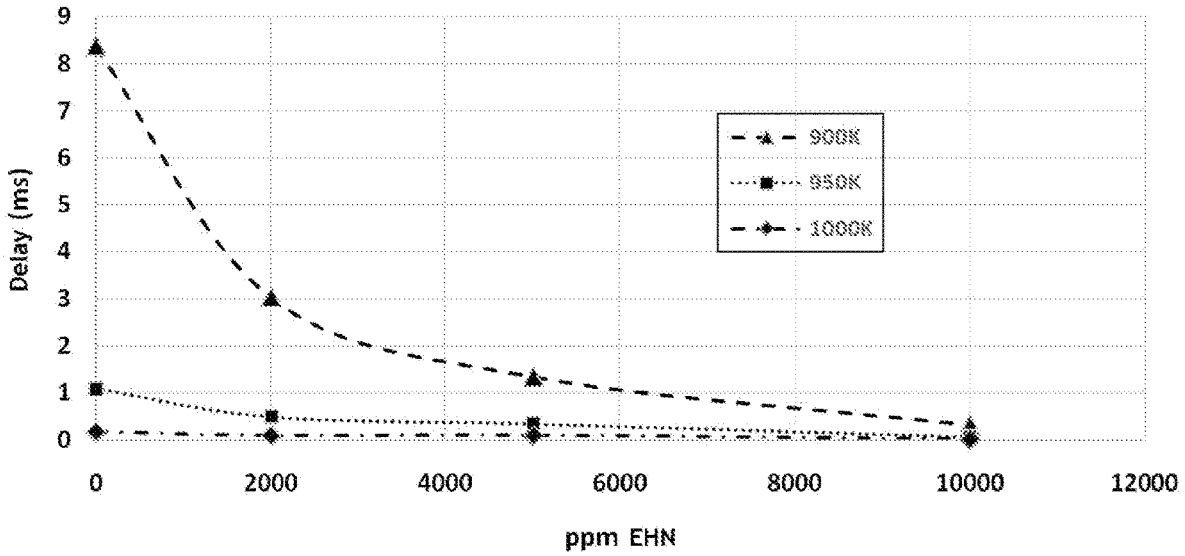
FIG. 7 is an expanded view of FIG. 6 over the temperature range of 900K to 1000K.

The ignition delays of different fuels containing either methanol alone or a mixture of methanol and EHN at 0.2%, 0.5% or 1% by weight, at different injection temperatures (temperature range 790K to 1000K), at a pressure Pc of 30 bar and a mixture richness of 1 with air, were determined. As can be seen in FIGS. 5 to 7, the addition of EHN to a methanol fuel results in a significant decrease in ignition delay compared to methanol alone.

These examples show that the use of alkyl nitrate(s) in a very low weight percentage can significantly improve the ignition delay of a methanol-based fuel. There was no reason to believe that additives known to increase the cetane number of a diesel or biodiesel hydrocarbon could be used so effectively, in very small quantities, to improve the ignition of an alcohol like methanol.

Although the presently disclosed subject matter and its advantages have been described in detail, it should be understood that various changes, substitutions and alterations can be made herein without departing from the spirit and scope of the application as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the presently disclosed subject matter, processes, machines, manufacture, compositions of matter, means, methods, or steps, presently existing or later to be developed that perform substantially the same function or achieve substantially the same result as the corresponding embodiments described herein can be utilized according to the presently disclosed subject matter. Accordingly, the appended claims are intended to include within their scope such processes, machines, manufacture, compositions of matter, means, methods, or steps. In addition to the various embodiments depicted and claimed, the disclosed subject matter is also directed to other embodiments having any other possible combination of the features disclosed and claimed herein. As such, the particular features presented herein can be combined with each other in other manners within the scope of the disclosed subject matter such that the disclosed subject matter includes any suitable combination of the features disclosed herein. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the composition, device, and method of the disclosed subject matter without departing from the spirit or scope of the disclosed subject matter. Thus, it is intended that the disclosed subject matter include modifications and variations that are within the scope of the appended claims and their equivalents.

For any patents, patent applications, publications, product descriptions, and protocols are cited throughout this application, the disclosures of all of which are incorporated herein by reference in their entireties for all purposes.

What is claimed is:

1. A compression ignition engine fuel which consists of from about 98.0% to about 99.9% by weight of liquid methanol and from about 0.1% to about 2.0% by weight of a liquid alkyl nitrate.

2. The fuel of claim 1, wherein the alkyl nitrate is a nitrate of a linear alkyl having from 4 to 36 carbon atoms, a nitrate of a branched alkyl having from 4 to 36 carbon atoms, a nitrate of a cyclic alkyl having from 5 to 18 carbon atoms, or a mixture of these nitrates.

3. The fuel of claim 1, wherein the alkyl nitrate is selected from the group consisting of: 2 ethyl hexyl nitrate, cyclohexyl nitrate, dodecyl nitrate, n-nonyl nitrate, 2-tetradecyl-1-octadecyl nitrate, hexyl nitrate, 2-octyl nitrate, isononyl nitrate, 2-propylheptyl nitrate, a mixture of $C_9$ to $C_{13}$ branched alkyl nitrates, and mixtures thereof.

4. The fuel of claim 1, wherein the alkyl nitrate is 2-ethylhexyl nitrate.

5. A method of obtaining a fuel according to claim 1, which comprises mixing, in a liquid state, an alkyl nitrate with methanol.

6. The method of claim 5, wherein the methanol and the alkyl nitrate are mixed in an engine tank.

7. The method of claim 5, wherein the methanol and the alkyl nitrate are mixed in an injector.

8. The method of claim 5, wherein the methanol and the alkyl nitrate are mixed in a premix chamber of an engine.

9. An engine containing a fuel as defined in claim 1.

10. A vehicle or vessel comprising an engine as defined in claim 9.

11. The fuel of claim 1, wherein the amount of liquid alkyl nitrate is from about 0.1% to about 1.0% by weight.

12. A method for igniting a fuel in a combustion engine, the method comprising operating the engine with the fuel, the fuel consisting of from about 98.0% to about 99.9% by weight of liquid methanol and from about 0.1% to about 2.0% by weight of a liquid alkyl nitrate.

13. The method of claim 12, wherein the amount of liquid alkyl nitrate in the fuel is from about 0.1% to about 1.5% by weight.

14. The method of claim 12, wherein the amount of liquid alkyl nitrate in the fuel is from about 0.1% to about 1.0% by weight.

15. The method of claim 12, wherein the alkyl nitrate is 2-ethylhexyl nitrate.

16. The method of claim 12, wherein the alkyl nitrate is selected from the group consisting of 2 ethyl hexyl nitrate, cyclohexyl nitrate, dodecyl nitrate, n-nonyl nitrate, 2-tetradecyl-1-octadecyl nitrate, hexyl nitrate, 2-octyl nitrate, isononyl nitrate, 2-propylheptyl nitrate, a mixture of C9 to C13 branched alkyl nitrates, and mixtures thereof.

17. The method of claim 12, wherein the alkyl nitrate and the methanol are mixed in an injector.

18. The method of claim 12, wherein the alkyl nitrate and the methanol are mixed in a premix chamber of the combustion engine.

* * * * *